United States Patent [19]

Bains

[11] 4,422,277

[45] Dec. 27, 1983

[54] PANEL JOINT

[75] Inventor: Gurdip S. Bains, Bethel Park, Pa.

[73] Assignee: Westinghouse Electric Corp., Pittsburgh, Pa.

[21] Appl. No.: 262,370

[22] Filed: May 11, 1981

[51] Int. Cl.[3] ..... E04C 1/10

[52] U.S. Cl. ..... 52/584; 52/583; 403/407

[58] Field of Search ..... 52/582, 583, 584; 403/407

[56] References Cited

U.S. PATENT DOCUMENTS

| | | | |
|---|---|---|---|
| 146,207 | 1/1874 | Schneider | 403/407 |
| 1,182,610 | 5/1916 | Wiesman | 403/407 |
| 1,648,591 | 10/1927 | Repay | 403/407 |
| 1,919,780 | 7/1933 | Fairbank | 403/407 |
| 2,268,636 | 1/1942 | Becker | 52/582 |
| 4,189,890 | 2/1980 | Bains et al. | 52/584 |
| 4,199,907 | 4/1980 | Bains et al. | 52/125 |
| 4,251,969 | 2/1981 | Bains | 52/584 |
| 4,363,201 | 12/1982 | Bains | 52/584 |

*Primary Examiner*—Alfred C. Perham
*Assistant Examiner*—David J. Thomas
*Attorney, Agent, or Firm*—D. R. Lackey

[57] ABSTRACT

Mid-wall panel joints for joining first and second upstanding wall panel members tightly together with their front surfaces in a common plane. First and second elongated alignment plates are fixed to the rear surfaces of the first and second wall panel members, respectively, adjacent to the edges to be joined, with each having a plurality of fingers which extend outwardly to vertically interleave with the fingers of the other alignment plate, and to contact the rear surface of the other wall panel members. A plurality of spacer members are fixed to the first and second alignment plates, with two vertical columns on each alignment plate. A plurality of similarly constructed joining members, each having four elongated slots or openings, complete the joint. The spacer members on the first and second wall panel members extend through spacer head receiving portions of the elongated slots, and the joining members are then downwardly advanced to a frictional locking position.

1 Claim, 7 Drawing Figures

PANEL JOINT

BACKGROUND OF THE INVENTION

1. Field of the Invention:

The invention relates in general to panel joints, and more specifically to a panel joint for joining two upstanding panel members tightly together with their front surfaces disposed in a common plane.

2. Description of the Prior Art:

In certain applications, wall panel members are required to be joined together to form a room or cubicle, with the joining hardware concealed. When the width of a wall exceeds a predetermined dimension, it is constructed of two or more in-line panels. The joints between the in-line panels must be tight, and they must remain tight during usage. The front surfaces of the in-line panels must be disposed in a common plane, and the composite wall must be flat without any bowing at the joint. Wall panels formed of wood or other non-metal panels, are relatively thick and heavy, and their surfaces may not be perfectly flat. The weight and non-flatness add to the problem of assembling panels with tight joints.

It would thus be desirable to provide new and improved panel joints for relatively large, heavy panels, which enables the panels to be quickly and tightly joined in-line with the desired orientation of the front panel surfaces in a common plane. It would further be desirable to remove or reduce any bow or out-of-flatness condition of the panel members, especially at the critical joint area, without increasing assembly time.

SUMMARY OF THE INVENTION

Briefly, the present invention includes new and improved panel joints for joining relatively thick wall panel members, such as panel members made of wood, or other non-metallic materials, in-line with concealed hardware.

First and second metallic alignment plates, each having a plurality of finger portions which extend outwardly in spaced parallel relation from a common back portion, are fixed to the back surfaces of first and second wall panel members, respectively, adjacent to the edges of the panel members which are to be butted together. A plurality of spacer members are fixed to the first alignment plate, in vertically spaced pairs, and a plurality of spacer members are fixed to the second alignment plate, in vertically spaced pairs, to form two vertical columns of spacer members on each alignment plate. The panel members are then ready for shipment to the job site, along with a plurality of metallic joining members. At the job site, the assembler positions the first and second wall panel members, such that the finger portions of each alignment plate vertically interleave with the finger portions of the other alignment plate and contact the rear surface of the other panel member. The joining members each have four horizontally spaced elongated openings or slots which engage a pair of spacer members on each of the first and second alignment plates. The assembler then pounds each metallic joiner member vertically downward, forcing each joining member tightly against the alignment plates, and forcing the two adjoining edges of the panel member tightly together by virtue of the slots which capture a pair of spacer members on one alignment plate being angled or inclined slightly from the vertical.

BRIEF DESCRIPTION OF THE DRAWINGS

The invention may be better understood, and further advantages and uses thereof more readily apparent, when considered in view of the following detailed description of exemplary embodiments, taken with the accompanying drawings in which.

DESCRIPTION OF THE PREFERRED EMBODIMENT

Figure 2:
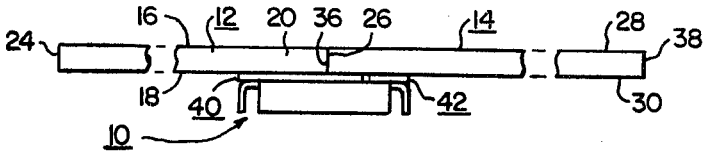
FIG. 2 is an plan view of the upstanding wall panel members and joint shown in FIG. 1.
Figure 1:
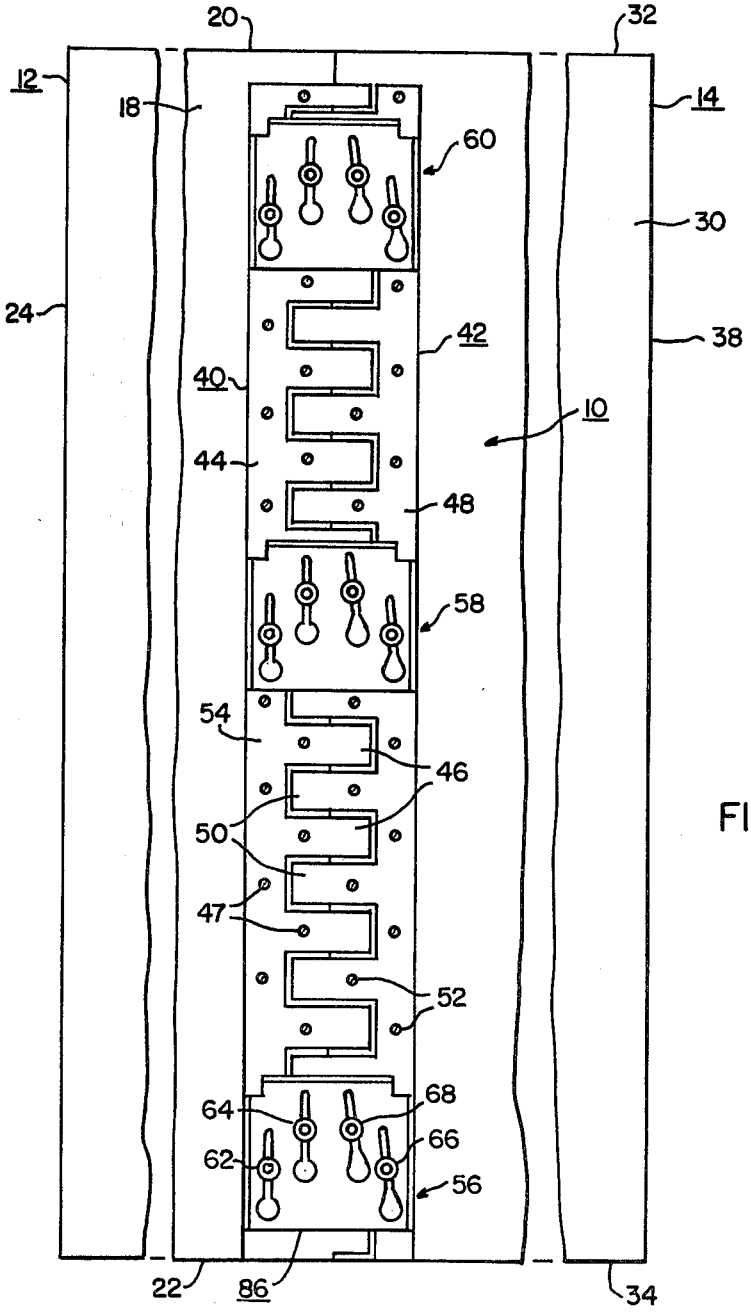
FIG. 1 is an elevational view of first and second upstanding wall panel members joined with a panel joint constructed according to the teachings of the invention.

FIG. 1 is an elevational view of a panel joint 10 constructed according to the teachings of the invention, with FIG. 2 being a plan view of joint 10. Joint 10 is especially suitable for joining wall panel members which have a uniform thickness dimension from panel to panel, but which may have a slight bow or waviness when viewed from an edge of the panel. Non-flat panels joined in-line with concealed hardware make an unattractive joint, if the panel surfaces are not aligned along the entire length of the joint. The joint of the present invention forces such alignment.

More specifically, panel joint 10 is an in-line joint, as opposed to an angular joint, with joint 10 joining first and second upstanding wall panel members 12 and 14. Wall panel members 12 and 14 are relatively large and heavy panels, formed of a material such as wood, or a wood substitute. Panel members 12 and 14 form a wall, or a portion of a wall, such as a wall for a cubicle which may be used as the cap for an elevator car. Wall panel member 12 has front and rear major flat surfaces 16 and 18, respectively, top and bottom edges 20 and 22, respectively, and first and second vertically extending side edges 24 and 26, respectively, with the second side edge 26 also being referred to as an "adjacent" edge, because it is the edge to be butted against wall panel member 14.

In like manner, wall panel member 14 has front and rear major flat surfaces 28 and 30, respectively, top and bottom edges 32 and 34, respectively, and first and second vertically extending side edges 36 and 38, respectively, with the first side edge 36 also being referred to as an "adjacent" edge. Joint 10 joins wall panel members 12 and 14 in-line with their front surfaces 16 and 28 aligned in a common vertical plane.

Joint 10 includes first and second elongated metallic alignment plates 40 and 42, fixed to the rear surfaces 18 and 30, respectively, of the first and second wall panel members 12 and 14.

Figure 3:
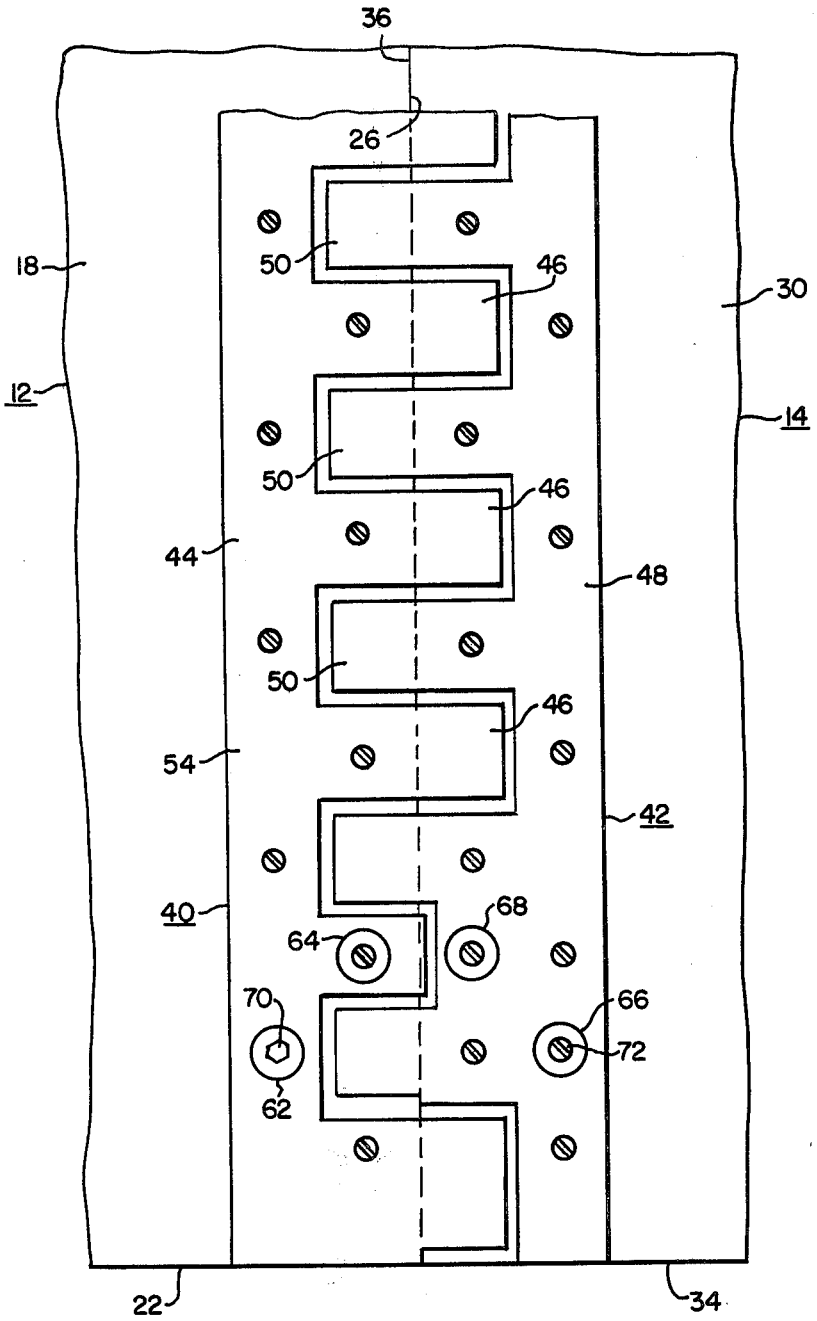
FIG. 3 is an enlarged fragmentary, elevational view of the upstanding wall panel members shown in FIG. 1, with alignment plates and spacer members attached, ready for the joining step.

As shown more clearly in FIG. 3, which is an enlarged, fragmentary view of the alignment plates 40 and 42, alignment plate 40 includes a vertically extending back portion 44 which, in a preferred embodiment of the invention, extends for substantially the complete length of the adjacent edge 26 of panel member 12, and a plurality of spaced finger portions 46 which extend outwardly from a common side of back portion 44. Back portion 44 is secured to surface 18 of panel member 12 with a plurality of suitable fastener members, such as screws 47. At least certain of the screws 47 are flathead screws which are recessed such that the flathead portion is flush with the surface of the alignment plate 40.

In like manner, alignment plate 42 includes a vertically extending back portion 48, which also preferably extends for substantially the complete dimension of the adjacent edge 36, with back portion 48 also including a plurality of spaced finger portions 50 which extend outwardly from a common side thereof. Back portion 48 is secured to surface 30 of panel member 14 via a plurality of fastener members, such as screws 52, at least certain of which are recessed.

The metallic alignment plates 40 and 42 are fixed near the adjacent edges 26 and 36, with the finger portions of each alignment plate extending outwardly past the adjacent edge of the panel member it is fixed to, such that the finger portions overlap and contact the rear surface of the other panel member. Finger portions 46 and 50 alternate or vertically interleave with one another such that there is no interference between them.

Alignment plates 40 and 42 are formed from metallic plate members or sheet members, such as a steel sheet having a thickness of about 0.188 inch. As hereinbefore stated, the alignment plates preferably extend for substantially the complete height of the associated panel member, in order to provide optimum stiffening and front surface alignment of the panel members. However, the invention is intended to cover certain modifications, such as forming each alignment plate of vertically aligned sections, each of which have a plurality of finger portions.

Each alignment plate 40 and 42 includes a first major, flat surface disposed against the associated panel member, and a second major flat surface, such as surface 54 of plate 40. The alignment plates 40 and 42 each have a plurality of holes formed therein for receiving screws, with the holes for receiving the flathead, recessed screws being countersunk on side 54.

Joint 10 includes a plurality of discrete joint assemblies, such as first, second and third discrete joining assemblies 56, 58 and 60, respectively, which are similar in construction, with each of the joining assemblies including the first and second alignment plates 40 and 42. Since the additional elements of each joining assembly are similar, only joining assembly 56 will be described in detail.

More specifically, joining assembly 56 includes first and second spacer members 62 and 64 fixed to surface 54 of alignment plate 40. Spacer members 62 and 64 are horizontally spaced, and, as illustrated, they may be offset slightly in the vertical direction to enable the slots which they will cooperate with to be disposed closer together. The first and second spacer members 62 and 64 form a first pair. In like manner, third and fourth spacer members 66 and 68 are fixed to alignment plate 42, to provide a second pair. Spacer members 62 and 66 may be located at like vertical positions, and spacer members 64 and 68 may be disposed at like vertical positions. As illustrated in FIG. 3, finger members 46 and 50 may be modified slightly at the locations of joining assemblies 56, 58 and 60, in order to accommodate balanced positioning of the spacer members on the two alignment plates. The spacer members may be fixed to the alignment plates, and thus to the panel members, using screws, or bolts with recessed tee-nuts, or both, such as a bolt 70 associated with spacer member 62, and a screw 72 associated with spacer member 66.

Since the spacer members may all be of like construction, only spacer member 66 will be described in detail. More specifically, as shown more clearly in FIG. 7, spacer member 66 is a metallic member which includes a smooth, round shank portion 76 having a predetermined diameter, such as about 0.5 inch, and the length dimension in the direction of its longitudinal axis 78 which is slightly greater, i.e., about 0.005 inch greater, than the thickness dimension of an alignment plate plus the thickness dimension of a metallic joining member, which will be hereinafter described. Spacer member 66 further includes a smooth, round head portion 80 having a predetermined diameter, such as about 0.75 inch, and a length dimension of about 0.125 inch. Instead of the shank 76 and head 80 joining at right angles relative to one another such that the underside of the head forms a flange, an angled or tapered cam surface 82 is provided between shank 76 and head 80. Cam surface 82 defines a predetermined angle with shank 76, such as an angle of about 25°. The longitudinal length of cam surface 82, i.e., measured along the longitudinal axis 78 of spacer member 66, is about 0.25 inch.

As hereinbefore stated, the spacer members may all be of like construction. In another embodiment of the invention, the spacer members fixed to alignment plate 42 may be constructed as hereinbefore described, with the spacer members 62 and 64 which are fixed to alignment plate 40 having a different construction. Spacer members 62 and 64 in this embodiment may be constructed without the tapered transition, such that the underside of the head portion forms a right angled flange.

Returning now to spacer member 66, spacer member 66 is secured to the alignment plate 42, and thus to the panel member 12, via suitable fastener means, such as the screw 72. Spacer member 66 may have an opening coaxial with its longitudinal axis 78 for receiving the screw 72. A pilot opening is pre-drilled in alignment plate 42 to accurately locate and guide screw 72. Tee-nuts and bolts may be used to secure the alignment plates, and/or spacer members, at preselected locations, in order to provide a plurality of highly secure anchor points.

The spacer members 62, 64, 66 and 68 are attached to the alignment plates with the centers of the spacer members located on common vertical imaginary lines spaced predetermined dimensions from the adjacent edge of the associated wall panel member, with the spacer members of the joining assemblies 58 and 60 also being disposed on the same four vertical imaginary lines, to provide four vertical columns of spacer members, with three spacer members, for example, in each vertical column.

Figure 4:
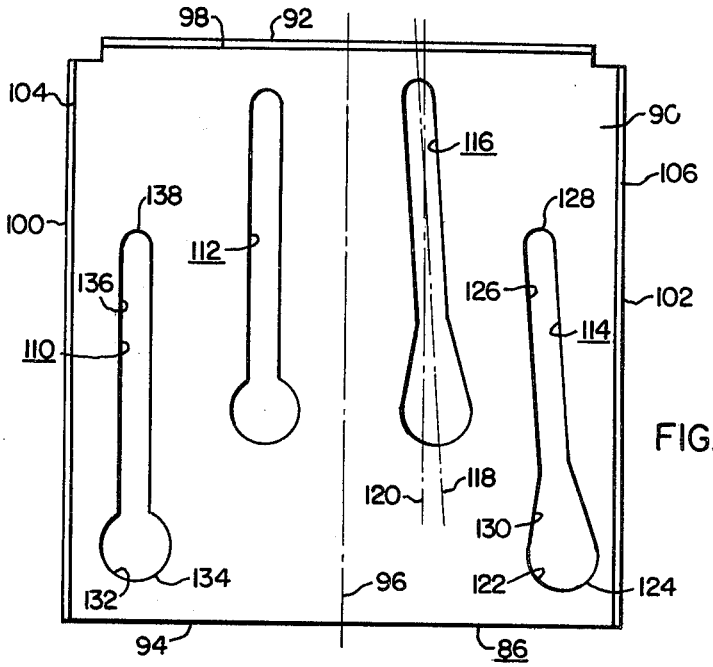
FIG. 4 is an elevational view of a joining member constructed according to the teachings of the invention.
Figure 5:
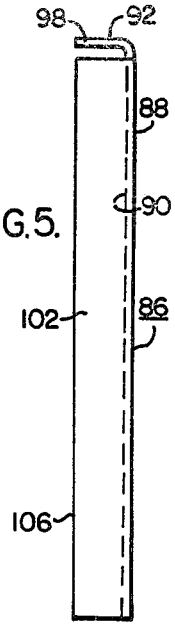
FIG. 5 is an end view of the joining member shown in FIG. 4.
Figure 6:
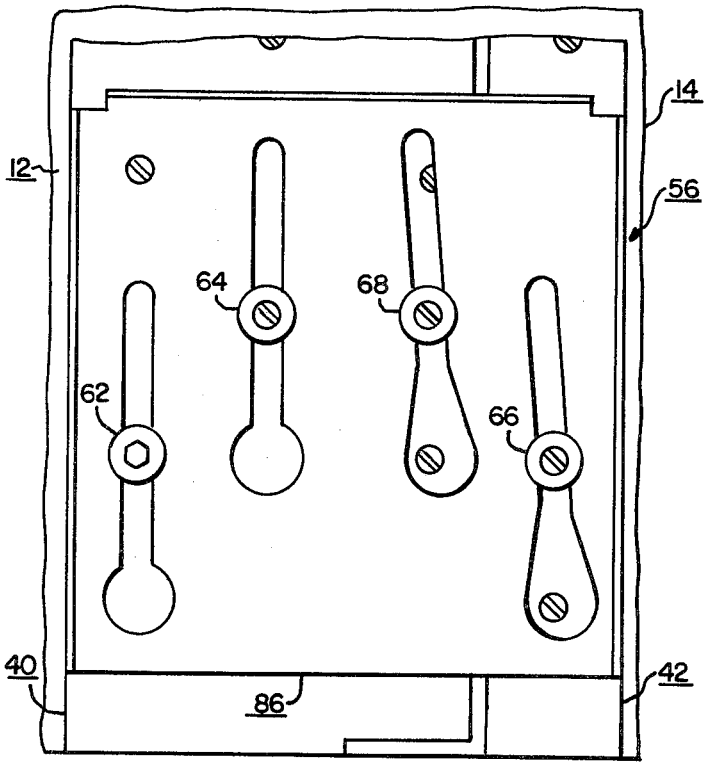
FIG. 6 is an enlarged fragmentary, elevational view of one of the joining members shown in FIG. 1, in its downwardly forced, frictional locking position.
Figure 7:
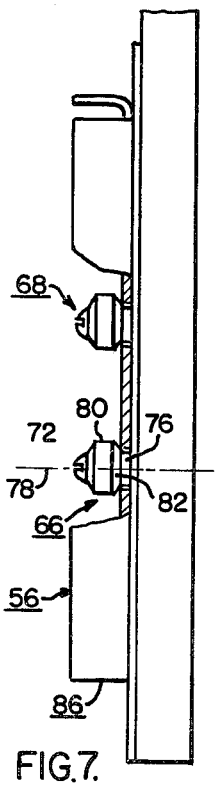
FIG. 7 is an end view of the assembled joining member shown in FIG. 6.

Joining assembly 56 is completed by a joining member 86, best shown in FIGS. 4 and 5. FIGS. 4 and 5 are front and end elevational views of joining member 86, respectively, and FIGS. 6 and 7 are front and end elevational views of joining assembly 56, illustrating joining member 86 disposed in assembled relation with alignment plates 40 and 42 and spacer members 62, 64, 66 and 68. Joining member 86 is formed from a metallic plate member, such as a steel plate member, which has a generally rectangular or square configuration, with the joining member 86 having first and second major, opposed, flat surfaces 88 and 90, respectively. Joining member 86 further includes upper and lower ends 92 and 94, respectively, and a longitudinal axis or center line 96 which extends between its ends. The upper end 92 is preferably defined by a flanged portion 98, which extends perpendicularly outward from flat surface 90. Joining member 86 also has first and second side edges 100 and 102, respectively, which are preferably defined by flanged portions 104 and 106, respectively. The various flanged portions provide a stiffening effect, and the flange portion 98 additionally provides a location for striking or hammering the joining member 86 into, or out of, a frictional locking position, which will be hereinafter described.

First and second vertically extending slots or openings 110 and 112 are provided on one side of longitudinal center line 96, and third and fourth elongated, substantially vertically extending slots or openings 114 and 116 are provided on the other side of center line 96. The longitudinal axes of slots 110 and 112 are vertically oriented, and the longitudinal axes of slots 114 and 116 are slightly inclined from the vertical, such that the upper end of each slot is closer to the longitudinal center line 96 than the lower end of the slot. For example, the longitudinal axis 118 of slot 116 is slightly inclined, such as by an angle of about 4° from a vertical line 120.

Slots 114 and 116 each have an enlarged first portion at their lower ends, a second portion which has parallel sides, which starts at the upper end of the slot, and a third portion in the form of a tapered transition which extends between the enlarged first portion and the second portion. For example, slot 114 has an enlarged first portion 122 at its lower end 124, a second portion 126 starting at its upper end 128, which portion has parallel sides, and a tapered, intermediate transition or third portion 130 which starts at the enlarged first portion 122 and tapers inwardly to the second portion 126. Enlarged portion 122 is constructed such that its lower end is in the form of a half circle, with the transition 130 extending from the ends of the half circle to the second portion 126. The diameter of the half circle is selected such that the head portion of the spacer member 66 will extend therethrough without interference. By vertically offsetting slots 114 and 116, they may be placed closer together, which reduces the width required for joint 10.

Slots 110 and 112 may have the same configuration as slots 114 and 116, especially when all of the spacer members are of like construction. Alternatively, they may be formed without the tapered transition, as illustrated, in which event the spacer members would be formed without the cam portion, as hereinbefore described. As illustrated, slot 110 may have an enlarged spacer head receiving portion 132 at its lower end 134, and a second portion 136 having parallel sides which start at its upper end 138 and intersects the enlarged portion 132.

In assembling panel members 12 and 14 with joint 10, the assembler uprights the panel members 12 and 14 in approximately the position they will assume when they are assembled. For ease in positioning the alignment plates 40 and 42 properly, panel members 12 and 14 may initially be angled slightly such that they provide an angle slightly less than 180°. When the adjoining edges 26 and 36 are just about touching, the assembler may then straighten the panels to cause the angle to swing to 180°, which will bring the finger portions of alignment plates 40 and 42 against the rear surfaces 30 and 18, respectively, of the panel members, as shown in FIG. 3. Each of the joining members 86 of the joining arrangements 56, 58 and 60 are then placed in position such that the spacer members 62 and 64 enter the enlarged portions of the elongated slots 110 and 112, respectively, and are captured thereby. Alternatively, the joining members 86 may already be assembled to alignment plate 40. Joining member 86 is held tightly against alignment plate 40 while spacer members 66 and 68 are captured by slots 114 and 116, respectively. The screws 47 and 52 are recessed, at least where the joining members will be slidably and vertically operated, in order to permit surface 88 of joining member 86 to lie snugly against the alignment plates. The tapered cam surface 82 of the spacer members 66 and 68, and the tapered transitions 130 of slots 114 and 116, allow capture of the spacer heads, notwithstanding a slight misalignment between the panel members and/or a slight bowing at the joint. The assembler then strikes the top edge or flange portion 98 of the joining members 86 with a hammer, forcing each joining member 86 into a downwardly displaced, frictional locking position, as shown in FIGS. 1 and 6.

As each joining member 86 is forced vertically downward, the tapered transition of slots 114 and 116 not only make it easy to capture the heads of the spacer members 66 and 68 in the slots, but continued downward movement of joining member 86 results in the narrowing taper of transition 130 camming the joining member 86 into tight engagement with the alignment plates 40 and 42. The plurality of joining members 86, being tightly cammed against the alignment plates, forces the alignment plates 40 and 42 into a common plane. Since surfaces 18 and 30 of the panel members 12 and 14 are forced into a common plane, especially in the joint area, their front surfaces 16 and 28 are forced into a common plane at the joint area, with no mismatch or step. Continued downward movement of joining member 80 to its final locking position causes the adjoining edges of the panel members 12 and 14 to be drawn tightly together due to the inclined surfaces of slots 114 and 116 acting upon the spacer members 66 and 68, to move wall panel member 14 tightly against wall panel member 16.

I claim as my invention:

1. A panel joint, comprising:

first and second adjoining, upstanding non-metallic wall panel members having front and rear surfaces, and flat adjacent edges, with said flat adjacent edges being butted against one another, and with the front surfaces of the panels being in a common plane, and joining means disposed adjacent to the rear surfaces of said first and second wall panel members, said joining means including first and second metallic alignment plates, a plurality of metallic spacer members, and a plurality of metallic plate members, said joining means holding said wall panel members tightly together to provide a tight joint between their front surfaces, devoid of visible joining means, while aligning the front surfaces in a common plane at the joint, said first and second metallic alignment plates having first and second major, flat surfaces, said first and second alignment plates each having a back portion and a plurality of spaced finger portions which extend outwardly from a common side thereof, the first major flat surfaces of said back portions of the first and second alignment plates being fixed to the rear surfaces of said first and second wall panel members, respectively, along their adjacent edges, with their finger portions extending outwardly from the associated wall panel member to vertically interleave with one another and contact the rear surfce of the other wall panel member, said plurality of metallic spacer members having head and shank portions, said spacer members being fixed in vertically spaced pairs to each of said first and second metallic alignment plates, with the spacer members of each pair being substantially horizontally spaced, said plurality of metallic plate joining members each comprising a flat section having first and second major, flat, parallel opposed surfaces defining first, second third and fourth elongated slots which extend between the opposed surfaces, said first and second slots being disposed on one side of a vertically extending longitudinal axis of the joining member, and said third and fourth slots being disposed on the opposite side, said first and second slots each having sides which are parallel with the longitudinal axis, and said third and fourth slots each having sides which are parallel with one another, but slightly inclined relative to the longitudinal axis, said plurality of joining members being disposed with their first surfaces in flat, surface-to-surface contact with the second major flat surfaces of said first and second alignment plates, with a pair of spacer members on said first alignment plate being captured by said first and second slots, and a pair of spacer members on said second alignment plate being captured by the third and fourth slots, to provide a plurality of vertically spaced joining assemblies, with the first and second alignment plates being common to all of said joining assemblies, said plurality of joining members being in a downwardly displaced, frictional locking position, with the inclined third and fourth slots forcing the associated pair of spacer members on the second wall panel member towards the first wall panel member, to urge the adjoining flat edges of said first and second wall panel members tightly together, at least certain of said spacer members including means which forces the first major, flat surfaces of the metallic joining members tightly against the second major, flat surfaces of said first and second metallic alignment plates, forcing the first surfaces of the first and second panel members into a common plane at the location of each joining assembly, and with the fifrst and second alignment plates, being common to all the spaced joining assemblies, promoting such alignment between the metallic joining members.

* * * * *